US005404665A

United States Patent [19]

Choi

[11] Patent Number: 5,404,665

[45] Date of Patent: Apr. 11, 1995

[54] GAS FILLER OPENING INDICATOR AND ADVERTISING DISPLAY FOR AUTOMOBILE

[76] Inventor: Mansung Choi, New York, N.Y.

[21] Appl. No.: 761,688

[22] Filed: Sep. 18, 1991

[51] Int. Cl.[6] ..... G09F 3/10

[52] U.S. Cl. ..... 40/630; 40/594

[58] Field of Search ..... 40/630, 638, 594; D20/27, 28, 35; 180/90

[56] References Cited

U.S. PATENT DOCUMENTS 4,235,459 11/1980 Callahan ..... 40/594 X 4,244,125 1/1981 Corey ..... 40/638

OTHER PUBLICATIONS

Ford Taurus Brochure, Sep. 1985, backview, bashboard, sideview.

*Primary Examiner*—Kenneth J. Dorner

*Assistant Examiner*—J. Bonifanti

*Attorney, Agent, or Firm*—Robert W. J. Usher

[57] ABSTRACT

Three small stickers, mounted on a backing sheet, carry, respectively, different indicia indicating the location of the gas filler opening and an advertisers logo or trademark. The driver or gas pump attendant can select and remove the appropriate sticker from the strip and adhere the selected sticker to the instrument panel adjacent the fuel level indicator thereby to remind the driver continually of the location of the gas filler opening of that automobile.

5 Claims, 2 Drawing Sheets

GAS FILLER OPENING INDICATOR AND ADVERTISING DISPLAY FOR AUTOMOBILE

FIELD OF THE INVENTION

The invention relates to information display devices for automobiles and, in particular, to a gas filler opening indicator and advertising display device.

BACKGROUND OF THE INVENTION

It is common, particularly when driving a rented automobile or one of several owned automobiles, to pull into a gas station without realizing the location on the automobile of the filler opening for the gas tank. Considerable inconvenience can be experienced if the filler opening tank is on the side of the automobile remote from the gas pump and, as a consequence, it is necessary to drape the gas line or hose across the automobile to reach the filler opening also with risk of damage to the paint work and gas spillage.

In some instances, the hose or gas line will still be too short and it will be necessary to replace the gas line on the pump, get back into the vehicle and change its position.

It is believed that as many as 30% of all drivers align their automobiles with the gas filler opening on the wrong side of the car, remote from the gas pump.

It has therefore long been desirable to provide some means for automatically reminding the driver of the position of the gas filler opening on the car when he decides to purchase gas.

It is of course well known to provide stickers carrying advertising material which adhere to windscreens and other parts of the automomobile to advise the driver when the next service is due and the lubricant to be used. However, such stickers do not provide for variable location direction indication.

According, to the invention, there is provided a display device comprising a sticker sized to adhere to the instrument panel or dashboard of an automobile adjacent the fuel level indicator, and carrying indicia indicating the position of the filer opening of the gas tank and, preferably, desired advertising material.

According to another aspect of the invention, there is provided a set of stickers or labels each adapted in size to adhere or otherwise be secured to the instrument panel of an automobile at a location adjacent the fuel level indicator, the stickers carrying, respectively, different indicia indicating the correspondingly different locations of the filler cap opening on the car and, preferably, advertising material such as a logo, other trademark of or name of the gas supplier.

Accordingly, the opportunity arises when an automobile pulls into a gas station with the filler opening on the remote (wrong) side for the attendant to select and offer or affix the correct sticker indicating the correct location of the filler opening to the dashboard.

As the driver normally looks at the fuel level indicator several times during any trip and, in particular, at the moment of decision to buy gas or recognition of need of gas, he will also have seen the adjacent sticker and have repeatedly (and automatically) been reminded of the correct location of the gas filer opening learning it quickly. At the same time, he will very quickly remember the logo of the advertiser thereon associating it with gratitude for the assistance provided.

The advertising material or logo can be of a beverage or other supplier instead of the gas company or garage.

Preferably, the labels or stickers of the set are located in side-by-side relation on a common backing strip for selective removal from the strip as required.

The indicia can take many forms, such as a picture of the gas pump with the delivery nozzle on the side thereof corresponding to the location of the gas filer opening on the automobile, or such markings as "R", "L" etc., appropriately directed arrows or other signs.

According to another aspect, the invention provides an instrument panel or dashboard of a vehicle carrying indicia adjacent the fuel level indicator indicating the position of the gas filler opening on that vehicle.

BRIEF INTRODUCTION TO THE DRAWINGS

A specific embodiment of the invention will now be described by way of example only with reference to the accompanying drawings in which.

Figure 1:
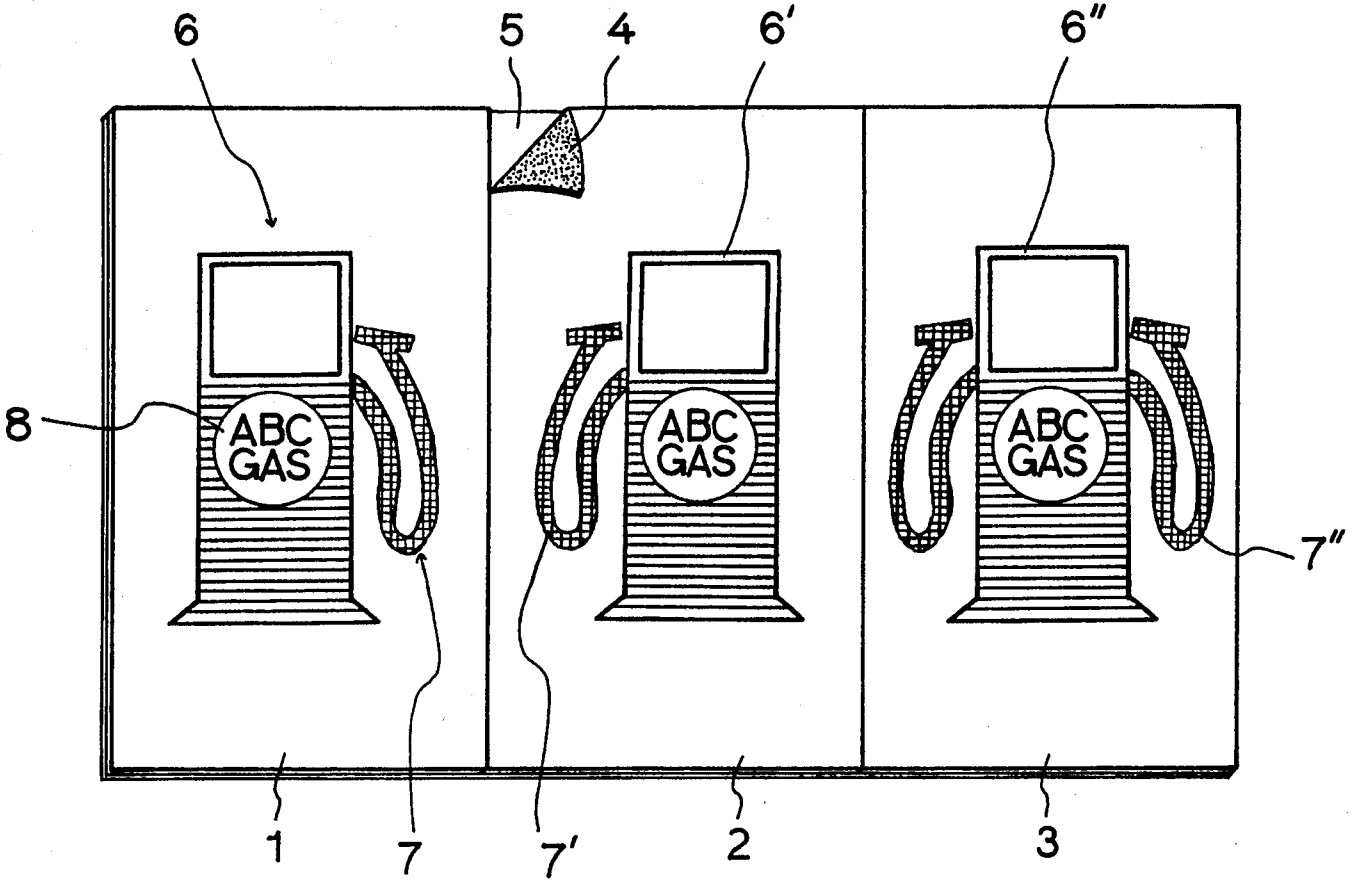
FIG. 1 shows a shows a composite strip of labels or stickers according to the invention.

As shown in the drawing, three stickers comprising sheets of paper or plastic, 1, 2, and 3 having an adhesive coating 4 on a rear thereof are mounted releasably in side-by-side relation on a backing strip 5. The stickers carry indicia 6, 6' and 6," respectively, showing gas pumps which vary only in the position of the illustrated gas nozzles 7, 7' and 7", respectively, according to the location e.g., left, right and rear, respectively, of the gas filler opening. Each sticker is sized to adhere to the instrument panel adjacent the fuel gauge, without obscuring adjacent instruments and is, therefore, quite small, of one to two centimeters (approximately 0.4–0.8 inches) in height.

Each sticker also carries the advertising logo or trademark 8 of a supplier such as a gas corporation, gas station, beverage corporation etc.

In use, the appropriate sticker may be selected and peeled from the backing sheet by a gas attendant or driver, turning over one corner therof, as shown in relation to the center sticker, and adhered to the instrument panel adjacent the field gauge to indicate the location of the gas filler opening.

The provision of the three, different, indicia on a single strip requires only a single item to be carried and handed to the driver irrespective of the actual location of the filler opening facilitating convenient storage and handling.

As an alternative to adhesive, the stickers (such term also including decals transfers or labels) may, where appropriate be adhered by magnetic attraction, suction or other known means being made, for example, of magnetic plastic material.

Figure 2:
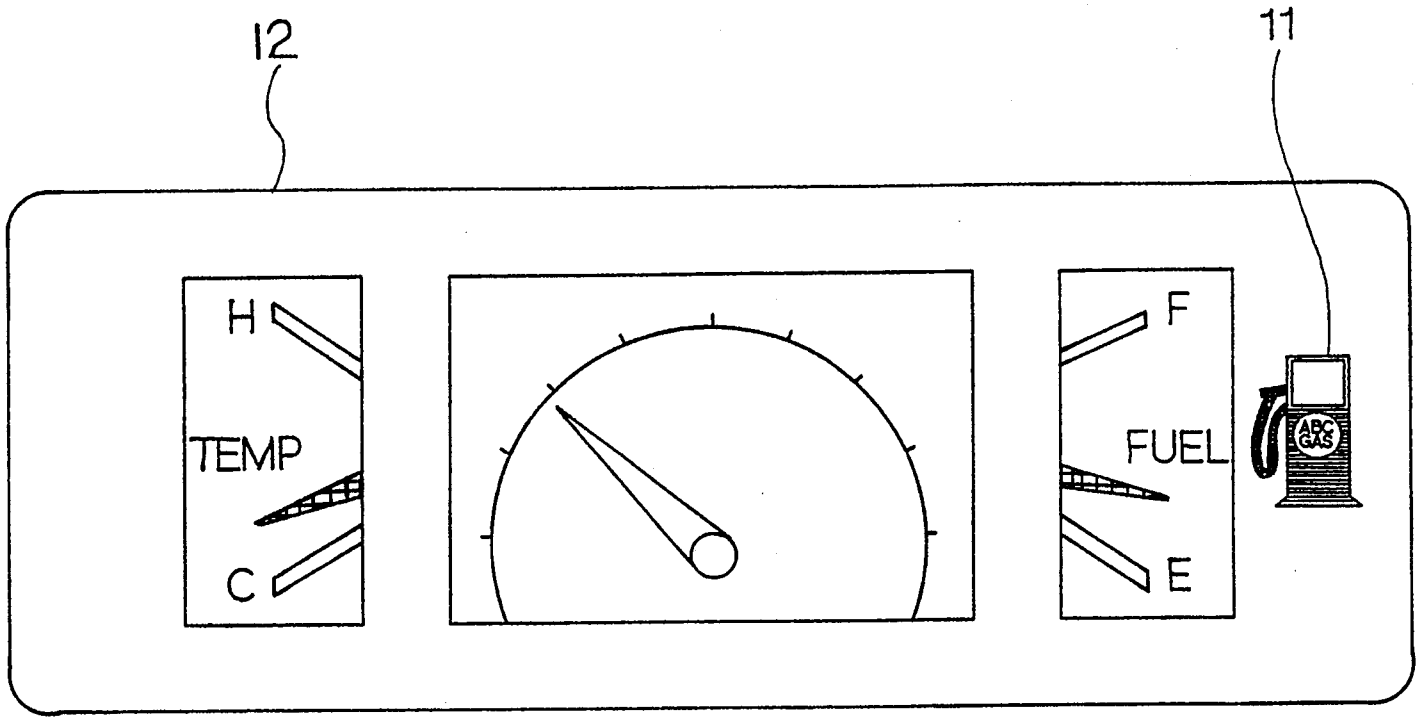
FIG. 2 is a schematic view of an instrument panel or dashboard carrying indicia according to the invention.

As shown in FIG. 2, the indicial 11 may also be printed on the dashboard 12 including on the instrument housing adjacent the fuel level indicator.

I claim:

1. A method for advertising gasoline comprising the steps of providing a supply of stickers carrying, respectively, different directional gas symbols corresponding to different locations of the gas filler opening on different automobiles and advertising material including one of a logo, trademark and name of the gasoline supplier, identifying the location of the gas filler openings on respective different automobiles, selecting and separating appropriate stickers from the supply and adhering respective selected stickers to the instrument panels or dashboards of the respective vehicles without obscuring adjacent instruments.

2. A method according to claim 1 in which stickers of the supply carrying different symbols are releasably mounted together as a set for selective removal in side-by-side relation on a backing strip.

3. A method according to claim 2 in which the set comprises stickers carrying, respectively symbols having left, right and rear identifying portions indicating a left, right and rear, location, respectively, of the gas filler opening on an automobile.

4. A method according to claim 1 in which in there are three different stickers in the supply, carrying symbols having left, right and rear identifying portions indicating a left, right and rear, location, respectively, of the gas filler opening on an automobile.

5. A method according to claim 1 including the step of identifying and selecting vehicles pulling into a gas station with the filler opening on the remote side from the gas pump for the selection and application of stickers thereto.

* * * * *